US009580289B2

(12) United States Patent
Peirsman et al.

(10) Patent No.: US 9,580,289 B2
(45) Date of Patent: Feb. 28, 2017

(54) BEVERAGE DISPENSING UNIT WITH OPENABLE PINCH VALVE

(71) Applicant: Anheuser-Busch InBev SA, Brussels (BE)

(72) Inventors: Daniel Peirsman, Brussels (BE); Sarah Van Hove, Brussels (BE); Johan Van Rompaey, Brussels (BE)

(73) Assignee: Anheuser-Busch InBev S.A., Brussels (BE)

( * ) Notice: Subject to any disclaimer, the term of this patent is extended or adjusted under 35 U.S.C. 154(b) by 0 days.

(21) Appl. No.: 14/398,387

(22) PCT Filed: Apr. 26, 2013

(86) PCT No.: PCT/EP2013/058690
§ 371 (c)(1),
(2) Date: Oct. 31, 2014

(87) PCT Pub. No.: WO2013/164258
PCT Pub. Date: Nov. 7, 2013

(65) Prior Publication Data

US 2015/0129617 A1 May 14, 2015

(30) Foreign Application Priority Data

May 2, 2012 (EP) ..... 12166357

(51) Int. Cl.

| | |
|---|---|
| ***B67D 1/00*** | (2006.01) |
| ***B67D 1/04*** | (2006.01) |
| ***B67D 1/06*** | (2006.01) |
| ***B67D 1/08*** | (2006.01) |
| ***B67D 1/12*** | (2006.01) |
| ***B67D 1/14*** | (2006.01) |

(52) U.S. Cl.
CPC ..... *B67D 1/1405* (2013.01); *B67D 1/0004* (2013.01); *B67D 1/06* (2013.01);
(Continued)

(58) Field of Classification Search
CPC ..... B67D 1/1405; B67D 1/0004; B67D 1/06; B67D 1/0857; B67D 1/0412;
(Continued)

(56) References Cited

U.S. PATENT DOCUMENTS

| | | | |
|---|---|---|---|
| 3,096,000 | A | 7/1963 | Staley |
| 4,049,158 | A | 9/1977 | Lo et al. |

(Continued)

FOREIGN PATENT DOCUMENTS

| | | |
|---|---|---|
| DE | 203 21 250 | 7/2006 |
| EP | 1 982 952 | 10/2008 |

(Continued)

*Primary Examiner* — Frederick C Nicolas
(74) *Attorney, Agent, or Firm* — Levy & Grandinetti

(57) ABSTRACT

A dispensing unit for dispensing a beverage from a pressurized container having a tapping column fixed to and extending normal to the top surface of a top plate with an opening and forming an elbow is disclosed. The column has an elongated inner channel bringing in fluid communication the support plate with a tapping pinch valve located in a tapping head at the elbow. The tapping pinch valve has jaws for receiving in pinching relationship the outlet end of the dispensing line and controlling flow of liquid by varying the distance between the jaws from a closed to an open position. A flexible dispensing line, having inlet and outlet ends, extends in the channel. The outlet end engages the pinch valve, and the inlet end connects to a keg. A device for opening the channel includes the pinch valve so a distance larger than the open position separates the jaws.

20 Claims, 4 Drawing Sheets

(52) U.S. Cl.
CPC ..... *B67D 1/0857* (2013.01); *B67D 1/0412* (2013.01); *B67D 1/1252* (2013.01); *B67D 1/1477* (2013.01); *B67D 2001/0092* (2013.01); *B67D 2001/0093* (2013.01); *B67D 2001/0094* (2013.01); *B67D 2001/0098* (2013.01); *B67D 2210/00041* (2013.01)

(58) Field of Classification Search
CPC ..... B67D 1/1252; B67D 1/1477; B67D 2001/0094; B67D 2001/0098; B67D 2001/00041; B67D 2001/0092; B67D 2001/0093; B67D 2210/00041
See application file for complete search history.

(56) References Cited

U.S. PATENT DOCUMENTS

| | | | | |
|---|---|---|---|---|
| 6,832,487 | B1 | 12/2004 | Baker | |
| 2004/0226967 | A1 | 11/2004 | Van Der Klaauw et al. | |
| 2013/0214011 | A1* | 8/2013 | Vandekerckhove | B67D 1/0829 222/505 |
| 2013/0221034 | A1* | 8/2013 | Vandekerckhove | B67D 1/0042 222/394 |
| 2014/0217126 | A1* | 8/2014 | Peirsman | B67D 1/0004 222/399 |

FOREIGN PATENT DOCUMENTS

| | | |
|---|---|---|
| EP | 2 146 832 | 10/2008 |
| EP | 2 148 770 | 10/2008 |
| EP | 2 148 771 | 10/2008 |
| EP | 2 152 494 | 10/2008 |
| EP | 11162787 | 4/2011 |
| GB | 2 358 854 | 8/2001 |
| WO | WO 02/14210 | 2/2002 |
| WO | WO 2006/086032 | 8/2006 |
| WO | WO 2006/086932 | 8/2006 |
| WO | WO 2006/103566 | 10/2006 |
| WO | WO 2008/014210 | 1/2008 |
| WO | WO 2009/115928 | 9/2009 |
| WO | WO 2009/142977 | 11/2009 |

* cited by examiner

BEVERAGE DISPENSING UNIT WITH OPENABLE PINCH VALVE

This Application is the U.S. National Phase of International Application Number PCT/EP2013/058690 filed on Apr. 26, 2013, which claims priority to European Application Number 12166357.9 filed on May 2, 2012.

TECHNICAL FIELD OF THE INVENTION

The present invention concerns beverage dispensing units for dispensing a beverage, typically a carbonated beverage like beer, from a pressurized container through a dispensing tube and a dispensing tap. In particular, it concerns a beverage dispensing unit allowing a highly simplified loading and unloading of a dispensing line.

BACKGROUND OF THE INVENTION

Draught beer is often preferred by consumers to bottled or canned beer. Draught beer is generally served at the counter of a public house out of a refrigerated keg provided with a fluid connection to a source of pressurized gas for driving the dispensing of the beer through a dispensing line fluidly connecting the keg to a dispensing tap, comprising a valve for controlling the flow out of said tap. In case of a temporary social event outside a public house, such as an outdoor event, wedding party, fair and the like, consumers like to be offered draught beer for consumption. Furthermore, above a critical volume of consumption, serving bottled or canned beer would be too expensive and would generate too much waste. For these reasons, roving or mobile beverage dispensing units, offering the same quality of beer as a draught beer served at a public house, were developed and brought to the market. They are designed to accommodate a keg or container containing the beer, with a source of pressurized gas, such as a pressure gas bottle or a compressor. The containers used can be traditional metal kegs as used in public houses, possibly but not necessarily of smaller dimensions, or can include so called bag-in-containers as disclosed e.g., in EP2146832, EP2148770, EP2148771, EP2152494 and the like.

For example, US2004/0226967 proposes a dispensing unit comprising a cooling chamber suitable for accommodating and cooling a beer keg, a hollow column supported on said cooling chamber and a dispensing head comprising a tap valve. A source of pressurized gas, such as a compressor or a CO2 cartridge is provided for ensuring the necessary pressure for driving the beer flow out of the keg. A dispensing tube fluidly connects the keg to the tap valve. For reasons of hygiene, the dispensing tube is disposable and must be changed with each new keg. In one embodiment, the dispensing line is even permanently coupled to the keg to ensure that it will not be used a second time. Upon use, a new keg can be installed into the cooling chamber, and fluidly connected to a source of pressurized gas, generally located in the same chamber. The dispensing line is either permanently coupled to the keg or must be coupled thereto, before it is run through a channel defined in the hollow column until the dispensing tube outlet reaches the dispensing head of the column and is engaged into the tap valve mechanism. This "bottom-up" insertion system, wherein the dispensing tube is installed starting from the keg (located at the bottom) all the way up to the dispensing head (located at the top) requires that the dispensing line be provided with a shut-off valve to prevent the flow of beer out of the keg before the dispensing line is in place in the tap valve. It is clear that providing a shut-off valve to a disposable tube increases substantially the cost of use of the system. Furthermore, it can be quite cumbersome to drive up a flexible dispensing line through the hollow column which outlet to the cooling chamber is positioned at the back thereof and can easily be appreciated when looking e.g., at FIG. 2 of US2004/0226967.

In order to facilitate the engagement of the dispensing tube into the tap valve, a rather critical operation which is difficult to control from the interior of the cooling chamber, WO2009/115928 suggests to allow the opening of the dispensing head so that the dispensing tube outlet emerging from the opening at the top of the column can be handled from outside the cooling chamber and engaged more comfortably into the tap valve mechanism.

EP1982952 extends the idea of allowing the opening of the column to the entire length thereof. This solution greatly simplifies the "bottom-up" installation of the dispensing tube since it needs only be passed from the interior to the exterior of the cooling chamber through a short channel crossing the top board of the cooling chamber before it can be handled from outside the cooling chamber, instead of having to drive it from the inside of the cooling chamber all the way up to the dispensing head.

In spite of the various solutions proposed to simplify it, the "bottom-up" installation of a disposable dispensing tube remains cumbersome since the user must crouch and engage the head and shoulders into the cooling chamber to access the opening connecting the cooling chamber to the dispensing column inner channel, push up the flexible tube either all the way up to the dispensing head like in US2004/0226967, or only until the outlet of the tube reaches the opening in the column as in WO2009/115928 and in EP1982952, at which point it must be grabbed from the outside before it falls back all the way down into the cooling chamber. Since this operation must be repeated with each new keg installed into the cooling chamber, if the installation of the tube is too uncomfortable, users may become reluctant to use such roving beverage dispensing unit.

The change of dispensing tube with every new keg remains a rather delicate operation, often to be performed in the dark, in noisy and crowded environment, and also in stressful conditions. The present invention proposes a solution to greatly simplify the loading of a new dispensing tube into a tapping column to bring the dispensing unit into operational condition whenever a new keg is loaded.

SUMMARY OF THE INVENTION

The present invention is defined in the appended independent claims. Preferred embodiments are defined in the dependent claims. In particular, the present invention concerns a kit of parts for dispensing a beverage out of a pressurized container, comprising:

(a) A first, at least partially flexible, beverage dispensing line, comprising an inlet end and an outlet end, the inlet end being provided with connecting means for coupling said inlet end to a container containing a liquid to be dispensed, and the outlet end comprising a flexible portion, and (b) A tapping unit comprising:

A support plate, defining in use a substantially horizontal plane, comprising a top surface and a bottom surface and an opening connecting said top and bottom surfaces, A tapping column, comprising an elongated portion extending substantially normal to said top surface and forming at the top thereof an elbow, one end of said tapping column being fixed to the top surface and comprising an elongated inner channel bringing in fluid communication the opening of the support plate with a tapping pinch-valve located in a tapping head positioned at or adjacent the elbow at the opposite top end of the tapping column and opening to ambient atmosphere facing towards the support plate, said tapping pinch-valve comprising first and second jaws (3*a*, 3*b*) suitable for receiving in pinching relationship the flexible portion of the outlet end (4*a*) of said dispensing line and for controlling the flow of liquid therethrough by varying the distance between the first and second jaws from a first, closed position, d0, wherein the flexible portion of the dispensing line is squeezed and no liquid can flow therethrough to a second, open position, d1, wherein the dispensing line is not squeezed completely and liquid can flow through the line, Characterized in that, said column comprises means for opening a portion of the channel spanning from some point of the elongated portion up to and including a portion of the elbow and the pinch valve, such that the first and second jaws can be separated from one another by a distance substantially larger than the one corresponding to the open position, d1. By separating the first and second jaws from one another upon opening a portion of the column, not only the insertion of a new dispensing tube into the channel is rendered easier, but also the engagement of the dispensing tube end between the jaws of the pinch valve is greatly facilitated compared with having to introduce the end of the dispensing tube through the thin gap, d1, left between the jaws in open position as is the case with existing dispensing units.

The opening means advantageously comprise a movable panel fixed to the column with fixing means, such as hinges, which, in closed position, covers an opening of the channel extending from said fixing means to at least the valve head and, in open position, exposes said opening to the user.

In a preferred embodiment, the inlet end of the dispensing line is such that it can be run through the channel and support plate opening from the top to the bottom surfaces thereof, and the outlet end thereof can be engaged between the first and second jaws (3*a*, 3*b*) of the pinch valve (3) upon closing the channel portion including the pinch valve.

For preventing that by accidentally opening the opening means the jaws get separated from one another whilst the dispensing tube is connected to a pressurized vessel containing liquid, so that said liquid freely and uncontrollably flows out of the unpinched dispensing tube, it is preferred that the opening means comprise safety means designed such that:

(a) When the movable panel is closed in a dispensing configuration, the smallest channel diameter, $D_{flow}$, is greater than the diameter of the dispensing tube, (b) When the movable panel is completely open allowing loading/unloading of the dispensing tube, the smallest diameter, $D_{load}$, of the channel is larger than the dimensions of the connecting means, thus allowing the insertion/removal of dispensing tube (4) into/from the channel (2); and (c) When the movable panel (1*b*) is slightly ajar, the smallest diameter, $D_{seal}$, of the channel is such that the dispensing tube (4) is pinched, thus blocking any flow of liquid therethrough.

The connecting means of the dispensing line preferably comprise at least one of a bayonet, a threaded nut, a pin, preferably with a safety feature, a resilient snap-fit to sealingly couple the dispensing line to the mouth of a container and to bring it in fluid communication with the interior of the container.

The openable portion of the channel preferably spans over at least 50% of the total length of the elongated portion of the column, preferably at least 75%, more preferably at least 85%. In a preferred embodiment, the tapping head enclosing the pinch valve comprises two half shells hinged together such that the tapping head can be opened to separate the two jaws from one another by a distance greater than, d1.

The support plate can be the top of a shallow housing containing a source of pressurized gas connected to the inlet of a second, pressure line, an outlet thereof comprising connecting means for coupling said inlet end to said container containing a liquid to be dispensed. The height of said housing should not be more than 250 mm, preferably not more than 200 mm, more preferably not more than 150 mm, most preferably not more than 100 mm, such that it may conveniently be used on top of worktop such as a traditional pub or kitchen counter, Alternatively, the support plate can close the top of a cooled compartment comprising refrigerating means, means for holding said container and, preferably, a source of pressurized gas connected to the inlet of a second, pressure line, an outlet thereof comprising connecting means for coupling said outlet end to said container containing a liquid to be dispensed. Such embodiment forms a stand-alone, roving dispensing device, which preferably comprises means for easily displacing the tapping unit from one place to the other, such as wheels.

In both foregoing embodiments, the source of pressurized gas can be a container containing pressurized gas, a gas compressor, gas adsorbed on a solid carrier, such as a zeolite, gas from the net, or any combination thereof.

The dispensing unit described above is suitable for use with:

(a) a container, preferably a bag-in-container, comprising a closure (8) provided with a first, dispense opening and a second gas opening suitable for receiving the inlet end of the dispense line and the outlet end of the gas line;

(b) a connecting device for coupling the inlet of the dispensing line and the outlet of the pressure line to the corresponding dispense and gas openings.

The dispensing unit described above is most suitable for dispensing a beverage such as beer, carbonated malt based beverages, e.g., non alcoholic beer, or cider.

BRIEF DESCRIPTION OF THE FIGURES

For a fuller understanding of the nature of the present invention, reference is made to the following detailed description taken in conjunction with the accompanying drawings in which.

DETAILED DESCRIPTION OF THE INVENTION

Figure 1:
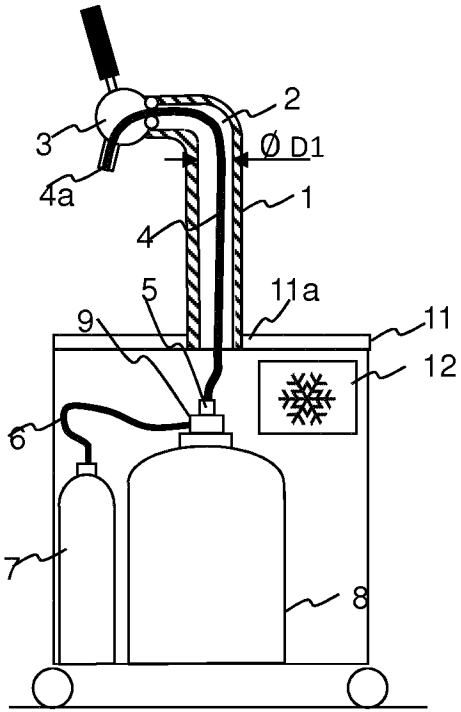
FIG. 1: shows one embodiment of a dispensing unit according to the present invention.
Figure 3B:
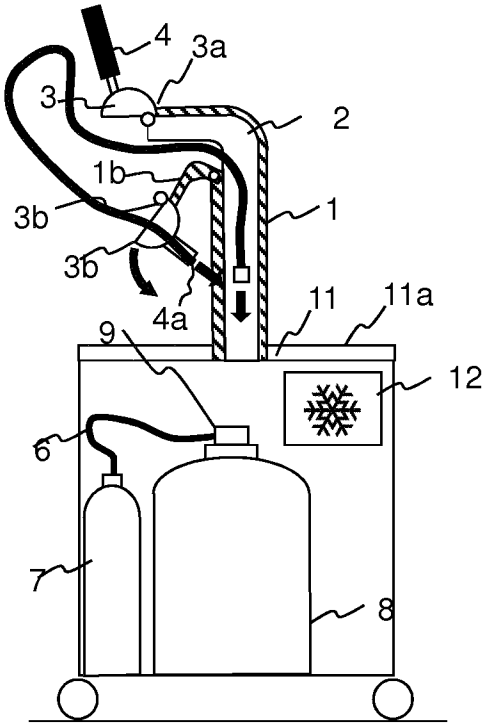
FIG. 3: shows four embodiments of how to install a new dispensing tube into a dispensing unit according to the present invention.
Figure 3A:
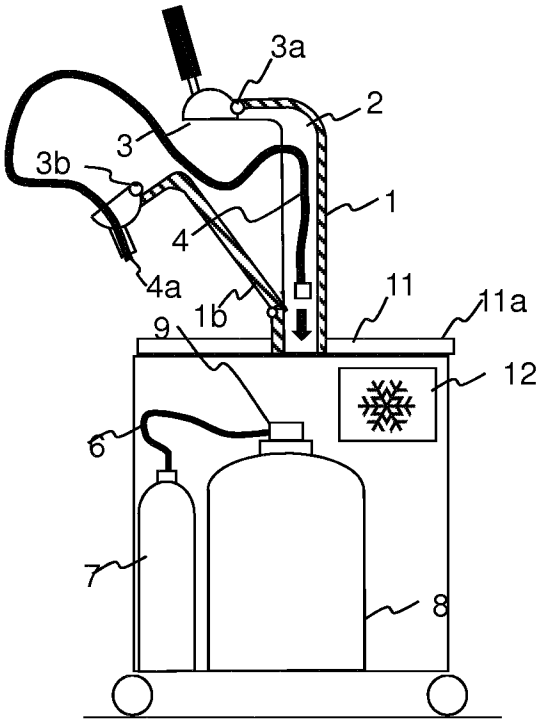
Figure 3D:
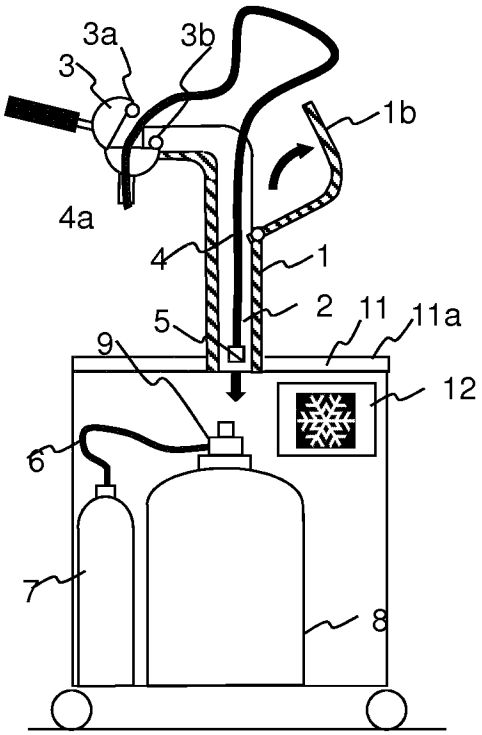
Figure 3C:
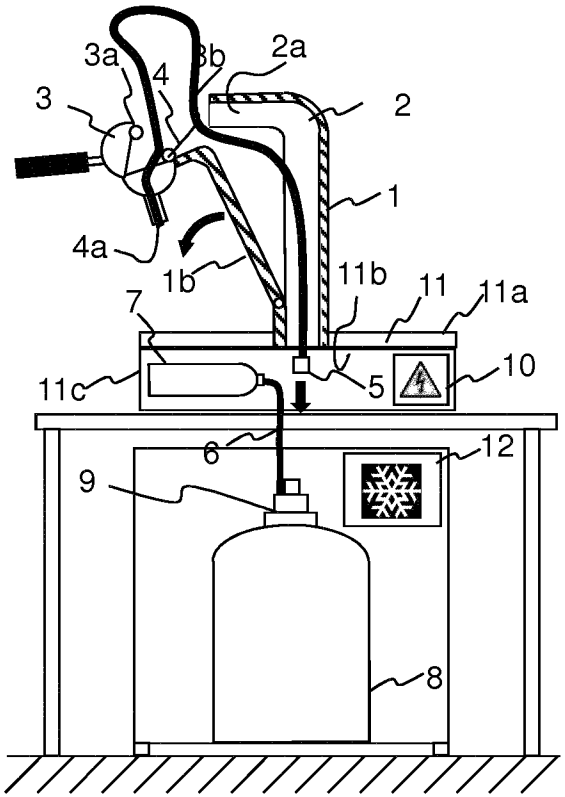

As illustrated in FIG. 1, the present invention concerns a beverage dispensing unit for dispensing a beverage from a pressurized container (8). The dispensing unit illustrated in FIG. 1 is a roving unit, provided with wheels to facilitate the displacement thereof, e.g., for use at temporary events. The present invention, however, is not restricted to roving dispensing units, and applies to any dispensing unit comprising tapping column (1), comprising an elongated portion extending substantially normal to the top surface (11*a*) of a support plate (11) provided with an opening and forming at the top thereof an elbow. One end—the "bottom end"—of said tapping column is fixed to the top surface (11*a*) and the column comprises an elongated inner channel (2) bringing in fluid communication the opening of the support plate with a tapping pinch-valve (3*a*, 3*b*) located in a tapping head (3) positioned at or adjacent the elbow at the opposite top end of the tapping column and opening to ambient atmosphere facing towards the support plate (11). In a preferred embodiment, the column is hollow, thus inherently forming the inner channel. In an alternative embodiment, the inside of the column can be filed with a compressible material, such as a foam or fibrillous mat, which can easily form a channel by compressing it. This embodiment is advantageous in that it thermally insulates from the outside conditions the dispensing tube running along the inner channel.

Dispensing units according to the present invention are particularly suitable for dispensing beer and beer like beverages (i.e., comprising malt), cider, and any other ready to dispense beverages. The dispensing units of the present invention distinguish themselves from soda dispensers wherein a source of carbonated water is mixed with a concentrated syrupy composition prior to flowing out of a tap. The use of a pump for pumping the beverage out of the outlet of the dispensing tube, as described e.g., in U.S. Pat. No. 6,832,487, is not envisaged as it makes a noise not to be associated with the serving conditions encountered in a public house, and in particular, driving beer through a pump is not compatible with the foam forming conditions required in a beer or beer like beverage. The dispensing of beverage in units according to the present invention is driven by the higher pressure reigning in the container compared with ambient. The high pressure in the container is achieved by bringing a source of pressurized gas (7) in fluid communication with the interior of the container (8) by a pressure tube (6). The source of pressurized gas (7) can be a pressurized bottle or cartridge, a connection to the net or a compressor, or any combination thereof. In the latter case, the beverage never contacts any element of the pump. This is used solely for increasing the pressure inside the container. In special kegs, containing an adsorbent carrier such as a zeolite or carbon black, it is possible to store the pressurizing gas in the container itself, adsorbed on said solid carrier as described, e.g., in WO02/014210, U.S. Pat. No. 4,049,158, WO2009/142977, U.S. Pat. No. 3,096,000; WO2006/086032, WO02/14210, and EP application number EP11162787.

Figure 2B:
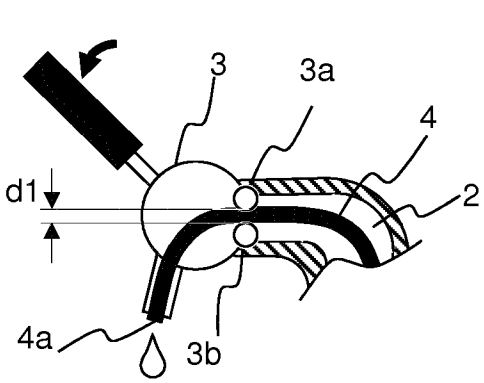
FIG. 2: shows a pinch valve (a) in closed, pinched position and (b). in open, dispensing position.
Figure 2A:
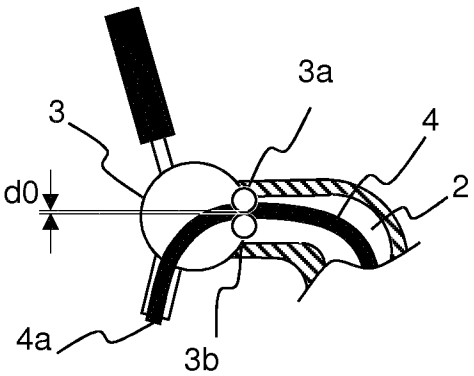

The container (8) which can be a standard metal keg or any container as revised in the Background Art section, in particular a bag-in-container, can be loaded inside a compartment or chamber comprising refrigerating means (12) for cooling the interior of the compartment. The cooling chamber can be integrated in the unit to form a stand-alone roving dispensing unit as illustrated in FIG. 1, or can be detached from the unit. In many public houses, the kegs are stored in refrigerated chambers located in a separate room than, often one floor below the tapping column or simply below the worktop supporting the dispensing column. The type and disposition of the cooling means are not critical to the present invention, and any known refrigerating system available on the market can be implemented. If a compressor or a pressurized bottle is used as source of pressurized gas, these can be accommodated inside the chamber as in FIG. 1, or in a housing suitable for being laid on top of a worktop as illustrated in FIG. 3(*c*). For example, the height of latter housing should not be more than 250 mm, preferably not more than 200 mm, more preferably not more than 150 mm, most preferably not more than 100 mm, such that it may conveniently be used on top of worktop such as a traditional pub or kitchen counter The dispensing unit of the present invention comprises a dispensing tube (4) which must be at least partially flexible and comprises a first, inlet end and a second, outlet end (4*a*). The terms "inlet" and "outlet" refer to the flow direction when the dispensing tube (4) is in operating position and in use. The dispensing tube (4) must be at least partially flexible in that, it must be suitable for following any curve of the inner channel (2) of the tapping column (1), and in particular the elbow at the top end thereof. The outlet end of the dispensing tube (4) must be engaged into a tapping valve suitable for controlling the flow of liquid out of the tube. In the present invention, the valve located in the valve head (3) of the tapping column (1) is a pinch valve comprising first and second jaws (3*a*, 3*b*) suitable, as illustrated in FIG. 2, for receiving in pinching relationship a flexible portion of the outlet end of the dispensing line (4) and for controlling the flow of liquid therethrough by varying the distance between the first and second jaws from a first, closed position, d0, wherein the flexible portion of the dispensing line is squeezed and no liquid can flow (cf. FIG. 2(*a*)), to a second, open position, d1, wherein the dispensing line is not squeezed or not squeezed completely and liquid can flow through the line (cf. FIG. 2(*b*)). The use of a pinch valve (3*a*, 3*b*) positioned in the valve head (3) at the top end of the tapping column is particularly advantageous because it is a cheap, hygienic and reliable valve system, requiring only that the outlet portion (4*a*) of the dispensing line be flexible to collaborate with the pinch valve.

When using the dispensing unit for the first time, or when using a new keg, a new dispensing tube (4) should be used for hygienic reasons and loaded in the unit to bring the liquid content of the new keg in fluid communication with the tapping valve head. Most tapping units require the dispensing tube to be introduced from below the support plate, through the opening and all the way up the channel until it reaches the valve head (3) and the outlet of the channel. This "bottom-up" loading method is often quite cumbersome and could lead a lazy user to re-use a dispensing line (4) several times by connecting the same line to several new kegs, thus increasing the risk of bacteriological contamination. US2004/0226967 discloses a container which is permanently connected to the dispensing tube, so that when a keg is empty it cannot be removed without removing at the same time the dispensing line (4). This of course forces a lazy user to change dispensing tube with each new keg, but it does not render the loading of the dispensing line through the channel of the column any easier. This is therefore not considered as an optimal solution.

For this reason, it is preferred that the dispensing column is such that the dispensing tube can be introduced in a "top-down" sequence, which is much easier to control than a "bottom-up" sequence. In other words, it is preferred that the inlet end of a dispensing tube including the connecting means (5) for fluidly connecting the tube with the interior of a keg can be introduced from the tapping column top end, preferably through the tapping valve head held in open position, all the way down below the support plate whence it can be led and connected to a new keg. The first inlet end of the dispensing tube, however, is provided with connecting means (5), generally larger in size than the cross-section of the dispensing line and used for connecting said inlet end to the container thus bringing the liquid contained in the container in fluid communication with the outlet end of the dispensing line. In a preferred embodiment, the connecting means (5) provide a releasable coupling to the container, such as by means of a bayonet, a threaded nut, a pin, preferably with a safety feature like a ring provided at one end thereof, and the like. In an alternative embodiment, the coupling obtained with the connecting means (5) to the container is permanent, such as with a resilient snap-fit. This solution offers the same advantage as the dispensing tube permanently connected to a container disclosed in US2004/0226967, in that when a keg is empty it cannot be removed without removing at the same time the dispensing line (4), so that a new dispensing line (4) must necessarily be mounted with the next keg, which ensures the hygienic conditions of the unit. By contrast with a dispensing tube permanently attached to the keg, the present invention using a snap-fit connecting means allows a friendlier "top-down" insertion of the dispensing tube.

Two conditions are required for allowing a top-down loading mode:

(a) first the connecting means (5) for coupling the inlet end of the tube to the mouth of a container must be smaller in size than the cross-section of the column's channel (2), at least during the loading of a new tube, such that it can be run therethrough and, (b) second, the insertion through the valve of either the inlet end, provided with the connecting means (5) or the outlet end must be easy.

Both of the foregoing requirements are fulfilled by the present invention, by providing the column (1) with means (1*b*) for opening a portion of the channel (2) spanning from some point of the elongated portion up to and including a portion of the elbow and the pinch valve, such that the first and second jaws (3*a*, 3*b*) can be separated from one another by a distance substantially larger than the one corresponding to the open position, d1. FIG. 3 illustrates various embodiments of dispensing units according to the present invention, wherein the loading of a new dispensing line (4) is substantially facilitated by providing an opening of at least a portion of the channel comprising both a portion of the extended portion thereof, as well as the elbow and the full separation of the first and second jaws (3*a*, 3*b*) from one another. By full separation it is meant herein, that the jaws are separated by a distance substantially larger than d1, their dispensing position when in use. FIG. 3(*a*) shows a first embodiment wherein a front panel (1*b*) extending over a substantial portion of the front end of the extended portion of the column is hinged such that it can be opened to give access to the interior of the channel (2). The extended panel (1*b*) also comprises a portion of the valve head (3) and second jaw (3*b*), whilst the other portion of the valve head (3) and first jaw (3*a*) remain coupled to the static portion of the column. With this embodiment, it can be seen that the loading of a new dispensing tube, both "bottom-up" and, as illustrated in the Figure, "top-down" is rendered extremely easy as ample room is allowed for introducing all the elements of the dispensing tube into the channel and between the jaws of the pinch valve. The second embodiment illustrated in FIG. 3(*b*) is quite similar to the one of FIG. 3(*a*) apart from the fact that the hinged panel (1*b*) extends over a reduced portion of the extended portion of the column. The first embodiment of FIG. 3(*a*) is advantageous over the second embodiment of FIG. 3(*b*) in that it allows for a "top-down" loading with a connecting means (5) of larger dimensions. Indeed, for aesthetical reasons, it is easier to design the column (1) with a broader base than the top, thus allowing for an inner channel of larger dimensions at the bottom of the column than at the top. This shows that the point of the elongated portion of the column wherein the panel (1*b*) is hinged really depends on the dimensions of each element of the unit and dispensing line. It is, however, preferred that the portion of the channel (2) which can be opened comprises at least 60% of the total length of the extended portion of the channel, preferably at least 80%, more preferably at least 90%. This facilitates the engagement of a new dispensing tube into the channel.

FIG. 3(*c*)&(d) illustrate an alternative embodiment, wherein the tapping valve head (3) as a whole remains coupled to either a hinged panel (1*b*) (cf. FIG. 3(*c*)) or to the static portion of the column (cf. FIG. 3(*d*)) and comprises a hinge assembly allowing the first and second jaws (3*a*, 3*b*) to be separated by a distance larger than the one corresponding to the open position, d1. It is preferred that the opening of a moving lid (1*b*) would trigger the opening of the valve head (3) about its hinges, for example by providing resilient means naturally biased such as to open the valve head, but restrained when the panel (1*b*) is closed. In an alternative embodiment the hinged tapping valve head (3) could be separable from the column (1) but it can be preferable to avoid any parts to be separable to avoid loss of a component. When FIG. 3(*a*)-(*c*) show embodiments wherein a hinged panel (1*b*) covers the front side of the column (i.e. on the side of the tapping outlet), FIG. 3(*d*) shows an embodiment wherein the hinged panel is located at the back of the column.

The main advantage of the dispensing units according to the present invention is that a new dispensing tube (4) can be introduced very easily both in a "top-down" sequence, from the top of the tapping column (1) through the inner channel (2) all the way down to the container where the inlet of the dispensing tube can be coupled to the mouth thereof by means of the connecting means (5), as well as in a more traditional, albeit cumbersome, "bottom-up" sequence, wherein the dispensing tube is run from beneath the support plate (11), up the channel and in between the jaws (3*a*, 3*b*) of the pinch valve with plenty of room and access for handling the tube.

To avoid that liquid would spill uncontrollably out of the dispensing tube in case the channel should inadvertently or accidentally be opened, the column of the dispensing unit according to the present invention can be provided with safety means (1*a*). In particular, as illustrated in FIG. 4, such safety means may be integrated in the design of the opening means (1*b*) such that, (a) When the movable panel (1*b*) is closed in a dispensing configuration, the smallest channel diameter, $D_{flow}$, is greater than the diameter of the dispensing tube (4) (cf. FIG. 4(*a*)), (b) When the movable panel (1*b*) is completely open allowing loading/unloading of the dispensing tube (4), the smallest diameter, $D_{load}$, of the channel is larger than the dimensions of the connecting means (5), thus allowing the insertion/removal of dispensing tube (4) into/from the channel (2) (cf. FIG. 4(*c*)); and (c) When the movable panel (1*b*) is slightly ajar, the smallest diameter, $D_{seal}$, of the channel is such that the dispensing tube (4) is pinched, thus blocking any flow of liquid therethrough (cf. FIG. 4(*b*)).

Figures 4A, 4B, 4C:
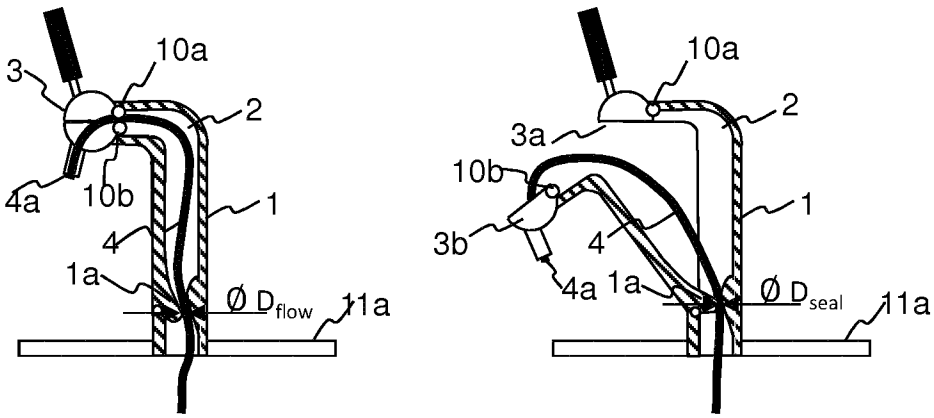
FIG. 4: shows safety means in case of an accidental opening of the column.

In FIG. 4, the safety means (1*a*) comprise a first protrusion provided on the hinged panel and acting as a moving jaw of a safety pinch valve depending on the degree of opening of the panel. The second jaw of such safety pinch valve can be the wall of the channel opposite the first protrusion; if necessary the wall of the channel may comprise a second, static protrusion collaborating with the first protrusion. The configuration of the safety means illustrated in FIG. 4 are suitable for use in the present invention, because the diameter, $D_{flow}$, of the channel during use (cf. FIG. 4(*a*)) needs only to accommodate the diameter of the dispensing tube (4) ($D_{flow} \geq d1$), whilst the diameter, $D_{load}$, of the channel (cf. FIG. 4(*c*)) must allow the passage of the connecting means (5) in case of a "top-down" loading mode ($D_{load} \geq D_{flow}$) In case the hinged panel (1*b*) should accidentally get unlocked and open by rotating about its hinges driven by gravity (cf. FIG. 4(*b*)), the protrusion of the hinged panel (1*b*) would act like a cam and reduce the smaller diameter, $D_{seal}$, of the channel to about d0 ($D_{seal} \simeq d0$), such that the dispensing tube (4) would get pinched thus interrupting the flow therethrough. If unloading of the tube is desired, it suffices to rotate the hinged panel (1*b*) a little further, so that the cam-like protrusion disengages from the opposite wall and increases the diameter of the channel to $D_{load}$ as illustrated in FIG. 4(*c*).

The invention claimed is:

1. A dispensing device for dispensing a beverage out of a pressurized container, comprising:

(a) A first, at least partially flexible, beverage dispensing line, comprising an inlet end and an outlet end the inlet end being provided with connecting device for coupling said inlet end to a container containing a liquid to be dispensed, and the outlet end comprising a flexible portion, and (b) a tapping unit comprising:

a support plate defining in use a substantially horizontal plane, comprising a top surface and a bottom surface and an opening connecting said top and bottom surfaces, a tapping column comprising an elongated portion fixed to, and extending substantially perpendicular to said top surface and forming an elbow at a top of the tapping column, and comprising an elongated inner channel bringing in fluid communication the opening of the support plate with a tapping pinch valve located in a tapping head positioned at or adjacent the elbow at the opposite top end of the tapping column and opening to ambient atmosphere facing towards the support plate, said tapping pinch valve comprising first and second jaws suitable for receiving in pinching relationship the flexible portion of the outlet end of said dispensing line and for controlling the flow of liquid therethrough by varying the distance between the first and second jaws from a first, closed position, d0, wherein the flexible portion of the dispensing line is squeezed and no liquid can flow therethrough to a second, open position, d1, wherein the dispensing line is not squeezed completely and liquid can flow through the line, wherein said column comprises a device for opening a portion of the channel spanning from some point of the elongated portion up to and including a portion of the elbow and the pinch valve, such that the first and second jaws can be separated from one another by a distance substantially larger than the one corresponding to the open position, d1.

2. The dispensing device according to claim 1, wherein said opening device comprises a movable panel fixed to the column with a fixing device, which, in closed position, covers an opening of the channel extending from said fixing device to at least the valve head and, in open position, exposes said opening to the user.

3. The dispensing device according to claim 2, wherein the inlet end of the dispensing line is such that the inlet end can be run through the channel and support plate opening from the top to the bottom surfaces thereof, and the outlet end thereof can be engaged between the first and second jaws of the pinch valve upon closing the channel portion including the pinch valve.

4. The dispensing device according to claim 3, wherein the opening device comprises a safety device designed such that:

(i) when the movable panel is closed in a dispensing configuration, the channel diameter, $D_{flow}$, is greater at all points than the diameter of the dispensing tube, (ii) when the movable panel is completely open allowing loading/unloading of the dispensing tube, the diameter, $D_{load}$, of the channel is larger at all points than the dimensions of the connecting device, thus allowing the insertion/removal of dispensing tube into/from the channel; and (iii) when the movable panel is slightly ajar, a diameter, $D_{seal}$, of the channel is such that the dispensing tube is pinched, thus blocking any flow of liquid therethrough.

5. The dispensing device according to claim 4, wherein the connecting device of the dispensing line comprises at least one of a bayonet, a threaded nut, a pin, or a resilient snap-fit.

6. The dispensing device according to claim 5, wherein a point defining a bottom level of the elongated portion of the channel which can be opened is separated from the elbow of the column by at least 50% of the total length of the elongated portion of the column.

7. The dispensing device according to claim 6, wherein the tapping head enclosing the pinch valve comprises two half shells hinged together such that the tapping head can be opened to separate the two jaws from one another by a distance greater than, d1.

8. The dispensing device according to claim 7, wherein the support plate is the top of a housing containing a source of pressurized gas connected to the inlet of a second, pressure line, an outlet thereof comprising a connecting device for coupling said inlet end to said container containing the liquid to be dispensed, the height of said housing being not more than 250 mm.

9. The dispensing device according to claim 8, further comprising a cooled compartment closed on the top by the support plate and comprising a refrigerating device, a device for holding said container and a source of pressurized gas connected to the inlet of a second, pressure line, an outlet thereof comprising a connecting device for coupling said outlet end to said container containing the liquid to be dispensed.

10. The dispensing device according to claim 9, comprising a device for easily displacing the tapping unit from one place to the other, including wheels.

11. The dispensing device according to claim 10, wherein the source of pressurized gas is a container containing pressurized gas, a gas compressor, gas adsorbed on a solid carrier, gas from a net, or any combination thereof.

12. The dispensing device according to claim 11, further comprising:

(c) a container comprising a closure provided with a first, dispense opening and a second gas opening suitable for receiving the inlet end of the dispense line and the outlet end of the gas line.

13. The dispensing device according to claim 12, further comprising:

(d) a connecting device for coupling the inlet of the dispensing line and the outlet of the pressure line to the corresponding dispense and gas openings.

14. The dispensing device according to claim 11, wherein the beverage to be dispensed and contained in the container is beer, a carbonated malt based beverage, including non-alcoholic beer, or cider.

15. The dispensing device according to claim 1, wherein the inlet end of the dispensing line is such that the inlet end can be run through the channel and support plate opening from the top to the bottom surfaces thereof, and the outlet end thereof can be engaged between the first and second jaws of the pinch valve upon closing the channel portion including the pinch valve.

16. The dispensing device according to claim 2, wherein the opening device comprises a safety device designed such that:

(i) when the movable panel is closed in a dispensing configuration, the channel diameter, $D_{flow}$, is greater at all points than the diameter of the dispensing tube, (ii) when the movable panel is completely open allowing loading/unloading of the dispensing tube, the diameter, $D_{load}$, of the channel is larger at all points than the dimensions of the connecting device, thus allowing the insertion/removal of dispensing tube into/from the channel; and (iii) when the movable panel is slightly ajar, a diameter, $D_{seal}$, of the channel is such that the dispensing tube is pinched, thus blocking any flow of liquid therethrough.

17. The dispensing device according to claim 1, wherein the connecting device of the dispensing line comprises at least one of a bayonet, a threaded nut, a pin, or a resilient snap-fit.

18. The dispensing device according to claim 1, wherein a point defining a bottom level of the elongated portion of the channel which can be opened is separated from the elbow of the column by at least 50% of the total length of the elongated portion of the column.

19. The dispensing device according to claim 1, wherein the tapping head enclosing the pinch valve comprises two half shells hinged together such that the tapping head can be opened to separate the two jaws from one another by a distance greater than, d1.

20. The dispensing device according to claim 1, wherein the support plate is the top of a housing containing a source of pressurized gas connected to the inlet of a second, pressure line an outlet thereof comprising a connecting device for coupling said inlet end to said container containing the liquid to be dispensed, the height of said housing being not more than 250 mm.

* * * * *